US005277204A

United States Patent [19]

Meyer et al.

[11] Patent Number: 5,277,204

[45] Date of Patent: Jan. 11, 1994

[54] DEVICE FOR THE DIRECTED SUPPLY OF TOBACCO RIBS TO A CUTTING TOOL

[75] Inventors: Meinhard Meyer, Unterglinde; Werner Wollburg, Ahrensburg; Friedrich Walther, Bargteheide; Wilfried Stiller, Holm; Arno Weiss, Norderstedt, all of Fed. Rep. of Germany

[73] Assignee: B.A.T. Cigarettenfabriken GmbH, Hamburg, Fed. Rep. of Germany

[21] Appl. No.: 971,178

[22] Filed: Nov. 4, 1992

[30] Foreign Application Priority Data

Nov. 6, 1991 [DE] Fed. Rep. of Germany ..... 4136498

[51] Int. Cl.[5] ..... A24B 7/14; A24C 5/39

[52] U.S. Cl. ..... 131/109.3

[58] Field of Search ..... 131/119, 109.1, 109.2, 131/109.3

[56] References Cited

U.S. PATENT DOCUMENTS

| | | | |
|---|---|---|---|
| 2,732,928 | 1/1956 | Schreiber | 198/59 |
| 3,532,099 | 10/1970 | Fuchu | 131/109.1 |
| 3,996,944 | 12/1976 | Hinzmann | 131/109.3 |
| 4,036,239 | 7/1977 | Preston | 131/109.1 |
| 4,090,521 | 5/1978 | Elsner | 131/109.3 X |
| 4,121,596 | 10/1978 | Labbe et al. | 131/109.1 |
| 4,149,547 | 4/1979 | Komossa et al. | 131/109.3 |
| 4,185,644 | 1/1980 | Heitmann et al. | 131/109.1 X |
| 4,254,781 | 3/1981 | Thiele et al. | 131/109.3 X |
| 4,306,574 | 12/1981 | Schlie et al. | 131/109.3 X |
| 4,601,297 | 7/1986 | Mattei et al. | 131/109.3 X |
| 4,756,315 | 7/1988 | Mattei et al. | 131/109.3 X |

FOREIGN PATENT DOCUMENTS

| | | |
|---|---|---|
| 2742857 | 4/1979 | Fed. Rep. of Germany . |
| 2903563 | 10/1979 | Fed. Rep. of Germany . |
| 2657550 | 4/1982 | Fed. Rep. of Germany . |
| 3408269 | 9/1985 | Fed. Rep. of Germany . |
| 2623497 | 12/1986 | Fed. Rep. of Germany . |
| 1196166 | 6/1970 | United Kingdom . |

*Primary Examiner*—William H. Grieb

*Attorney, Agent, or Firm*—Roylance, Abrams, Berdo & Goodman

[57] ABSTRACT

A device provides a directed supply of tobacco ribs to a cutting tool. A vibrator conveyor conveys the tobacco ribs into the inlet area of a press conveyor disposed upstream of the cutting tool. The vibrator conveyor includes vertical partitions extending in the direction of tobacco rib transport. The intervals between the partitions are less than the average tobacco rib length. A device regulates the level of the tobacco rib flow transported between the partitions. Tobacco ribs can be precisely aligned in the axial direction prior to cutting, and can be transferred to the cutting tool without any loss of orientation.

12 Claims, 2 Drawing Sheets

DEVICE FOR THE DIRECTED SUPPLY OF TOBACCO RIBS TO A CUTTING TOOL

FIELD OF THE INVENTION

The present invention relates to a device for the directed supply of tobacco ribs to a cutting tool. The tobacco ribs are conveyed by a vibratory conveyor into the inlet area of a press conveyor, and then to the cutting tool.

BACKGROUND OF THE INVENTION

In the manufacture of cigarettes, it is necessary to separate the actual leaf material from the ribs. The leaf tobacco is then processed separately from the ribs and supplied to the cigarette machines. However, the separate rib material can be re-supplied as filler to the tobacco supplied to the cigarette machine, provided the ribs have been suitably processed beforehand. A suitable processing step involves rolling the ribs prior to cutting.

DE 26 57 550 C2 discloses manufacturing a filler for cigarette and pipe tobacco, by cutting the ribs in the unworked state, transversely to the fibre direction, directly after a first setting of the moisture content. Following an intermediate storage, a second cutting step reduces the ribs to the required particle size for the filler. This publication discloses in principle, achieving the prospect of a large expansion of the cut rib material by the ribs being cut transversely to their longitudinal direction. A device for aligning the ribs is not disclosed.

German Offenlegungsschrift 34 08 269 discloses an appliance for aligning tobacco material by means of a vibratory conveyor equipped with partitions. In the area of the vibratory conveyor, baffle plates are only disposed in the initial area of the vibratory conveyor. The alignment of the tobacco rib flow can thereby already be re-suspended in the compression area of the press conveyor, in particular, if a pile-up should occur. The level is regulated by means of a simple, stationary stripper.

In DE 29 03 563 A1 and GB Patent Specification 1 196 166, appliances are described which enable tobacco ribs to be aligned. German Offenlegunsschrift 29 03 563 uses a vibratory conveyor. GB Patent Specification 1 196 166 guides the tobacco ribs through a fall shaft along a baffle, which shaft is equipped with sawtooth-like projections, fall ducts and a vibrator. In both cases, the object is an alignment of the tobacco ribs prior to introduction into a cutting tool, which executes a cross-splitting according to GB Patent Specification 1 196 166. The device disclosed in DE 29 03 563 A1 uses only one vibratory conveyor for the alignment of tobacco ribs and relies upon the effect of vibration movements to produce a high proportion of long fibred rib material. However, it expressly does not claim aligning all ribs identically. It has not partitions, nor does it have a level-regulating device.

Due to their low height, the sawtooth-like projections in a fall shaft of GB Patent Specification 1 196 166 allow only a correspondingly low throughput. Moreover, in the event of a pile-up, a disorientation of the already sorted tobacco ribs can result. This appliance also does not have a device for regulating the level of the tobacco flow.

German Patent Specification 26 23 497 relates to an appliance for aligning tobacco leaves, not tobacco ribs. The ribs are must more bulky, and thus, more difficult to handle, and must be cut in a precisely defined direction, namely in the transverse direction. Otherwise, the ribs display unfavorable expansion behavior, and further working with the cut tobacco is more difficult. The conveyor belts function as partitions, and exhibit an interval related to tobacco leaves. The alignment of the tobacco leaves is effected by the side walls exerting pressure upon the tobacco leaves. A level-regulating device is not provided.

Two other publications, German Offenlegungsschrift 27 42 857 and U.S. Pat. No. 2,732,928, disclose regulating the level of a tobacco flow in the catchment area of a press conveyor. The regulation is effected, in the case of German Offenlegungsschrift 27 42 857, by a conveyor worm. In U.S. Pat. No. 2,732,928, the regulation is effected by a feed hopper having a doctor blade.

New studies have shown that a cut of the ribs in the longitudinal direction, compared with a cut in the transverse direction, incorporates less favorable characteristics in relation to the expansion behavior, to the further working of the rib material with the cut tobacco and to the presence of longer components in a finished cigarette. Due to the automatic orientation of the rib material in the case of a vibratory conveyor of the type specified in German Patent Specification 29 03 563, this device is ruled out for a cross-cutting of rib material.

SUMMARY OF THE INVENTION

An object of the present invention is to provide a device for the directed supply of tobacco ribs to a cutting tool, by which the ribs can be cut in the transverse direction.

Another object of the present invention is to provide a device to enable a high-grade alignment of the rib material and to permit relatively high volume flows.

The foregoing objects are achieved by a device for directed supply of tobacco ribs to a cutting tool, comprising press conveyor means, vibratory conveyor means and regulatory means. The press conveyor means is disposed upstream of a cutting tool, conveys tobacco ribs to the cutting tool, and has an inlet area. The vibratory conveyor means is disposed upstream of the press conveyor means, conveys tobacco ribs into the inlet area and has vertical partitions extending longitudinally in a tobacco rib transport direction. The partitions are laterally spaced by a distance less than an average tobacco rib length and have ends protruding as far as the press conveyor means. The regulating means control the tobacco rib flow level between the partitions by controlling tobacco rib flow volume supplied to the vibratory conveyor means.

According to the present invention, the vibratory conveyor used for supplying the rib material to the cutting tool includes a number of vertical partitions extending in the direction of transport. The intervals between the partitions are each less than the average tobacco rib length, so that the rib material is guided between the partitions in alignment in the longitudinal direction. The ends of the partitions protrude as far as the downstream press conveyor, so that the tobacco rib flow is supplied to the press conveyor, upstream of cutting tool, at a relatively high transport height. The ribs nevertheless remain aligned in the direction of transport. A regulation of the level of the tobacco rib flow on the vibratory conveyor is also provided. In normal operation, a relatively high transport height is achieved as a result of pile-up, without the alignment of the tobacco ribs being suspended.

The device for regulating the level of the tobacco rib flow on the vibrator conveyor allows the rib flow supplied to the rib cutting tool to be shaped independently from the fluctuations in the volume flow supplied to the vibratory conveyor.

The regulation of the tobacco rib flow level fills the individual conveyor ducts between the partitions to an equal height with aligned ribs. As a result, a uniform compression of the rib cake is brought about in the mouthpiece of the cutting tool, so that the break-out of uncut ribs is minimized.

The level-regulating device is preferably a spiked cylinder. Such cylinder guides rib material exceeding a pre-specified level, back counter to the direction of transport of the ribs on the vibratory conveyor.

The control of the rib supply above the predetermined height level of the tobacco ribs in the area of the vibratory conveyor is preferably effected by means of optical sensors.

The device according to the present invention provides a very uniform supply of tobacco rib material to a cutting tool and a high-grade alignment of the ribs. The ribs are cut almost exclusively transversely to their longitudinal direction. In addition, the rolling prior to the cutting can be omitted, without the drawback arising from rib break-outs at the cutting mouthpiece.

The device according to the present invention can also be retro-fitted to existing cutting devices, where the supplying of the rib material was previously effected via a fall shaft. For this purpose, the rib flow can be diverted out of the fall shaft and initially be carried away from the fall shaft by a belt conveyor. The rib material is then turned around and guided, by the vibratory conveyor having the partitions, once again in the direction toward the cutting tool.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
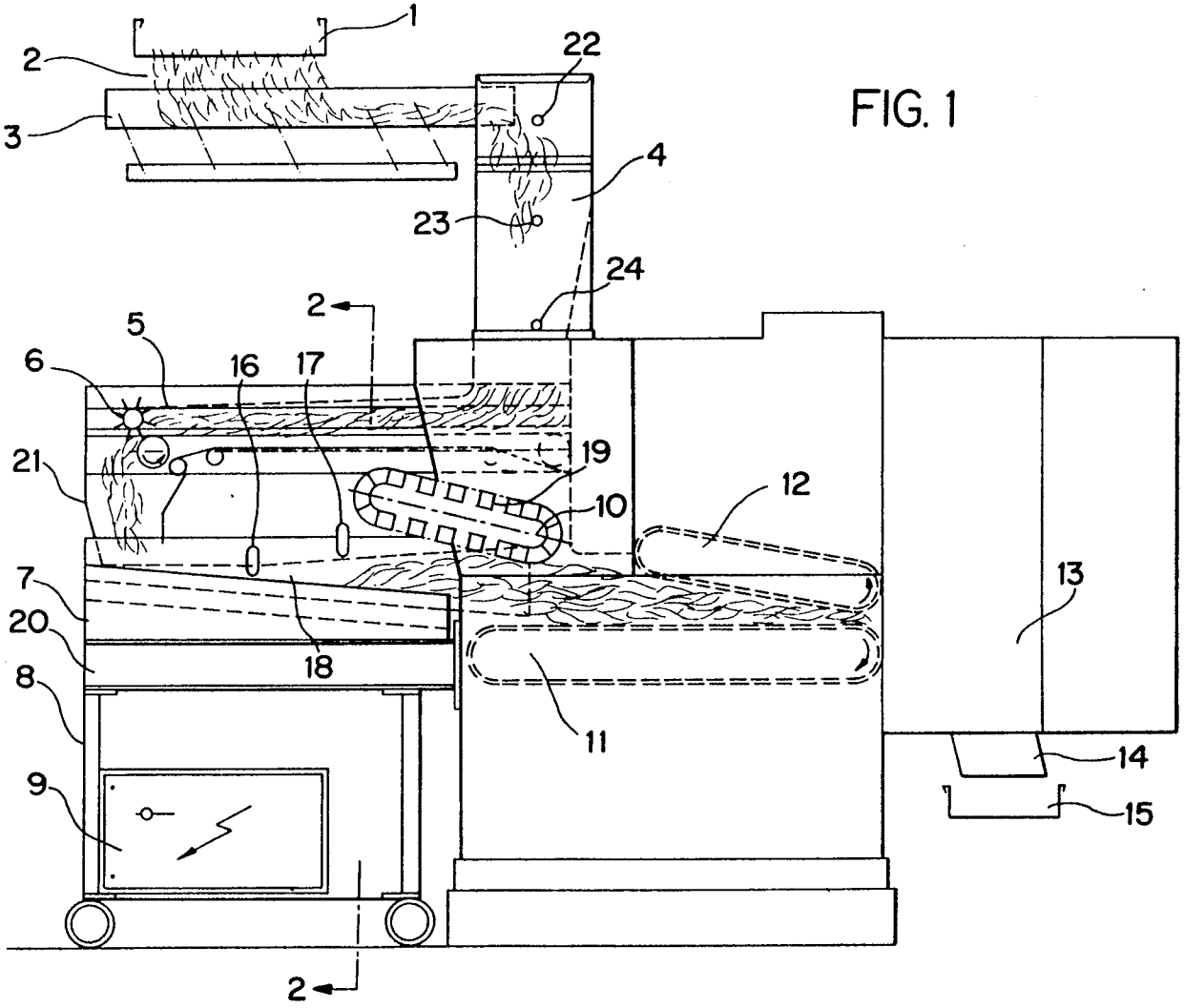
FIG. 1 is a side elevational view of a device for the directed supply of tobacco ribs to a cutting tool according to the present invention.

In FIG. 1, a side view of the arrangement according to the invention is shown. Tobacco ribs 2, separated from the leaf material, are supplied via a fall shaft 1 to a first vibratory conveyor 3. Conveyor 3 transfers the ribs into a further fall shaft 4. In a conventional installation, fall shaft 4 leads directly onto the press conveyor chain 11, from which the rib material is supplied in a state of disorder to the cutting tool 13.

The tobacco ribs 2 guided through fall shaft 4 are deposited on a conveyor belt 5, with the tobacco rib flow being initially horizontal and away from the cutting tool 13. At the end of the conveyor belt 5, the ribs are equalized in rib level by means of a combing cylinder 6 and are transferred via a third fall shaft 21 onto a second vibratory conveyor 7. Vibratory conveyor 7 is angled downwardly in the direction of transport and is located on a truck 8 having a drive unit 9, which can be moved in their entirety up to the cutting tool 13.

The vibratory conveyor 7 is constructed as a trough-shaped vat, in which are inserted a series of partitions 18, disposed vertically in the longitudinal direction. The top edges of the partitions 18 ascend in the direction of transport of the tobacco rib material. The ends of the partitions protrudes as far as the downstream press conveyor chain 11. At the downstream ends of the partitions 18, a caterpillar-shaped spiked cylinder 10, having a plurality of spikes 19, is located. Spikes 19 are disposed on chains and protrude between the individual partitions 18. The spiked cylinder 10, guided by means of two deflection rollers, extends at a downward angle in the direction of rib material transport.

At the top edges of the partitions 18, between the inlet end of the vibratory conveyor 7 and the spiked cylinder 10, two sensors 16 and 17 are located for detecting the height level of the tobacco rib flow transported by the vibratory conveyor 7.

The ribs are conveyed by the vibratory conveyor 7 onto the press conveyor chain 11. The entire rib flow is compressed by the two press conveyor chains 11 and 12 and are supplied, at their downstream end, to the cutting tool 13. From cutting tool 13, the particles which have been cut in the transverse direction fall via a fall shaft 14 onto a take-away conveyor 15 for supply to further processing stages.

The partitions 18 on the vibratory conveyor 7 exhibit a relatively small interval in comparison to the length of the individual tobacco ribs, for example 5 cm. The effect of this interval or spacing is that all tobacco ribs guided between the partitions are aligned in the axial or longitudinal direction. Since the partitions extend to the press conveyor chains 11 and 12, no re-orientation takes place when the tobacco rib flow is grasped by the conveyor chain 11. Instead, all the tobacco ribs remain in alignment in the axial direction until the ribs are cut by the cutting tool.

The performance of a cutting tool is essentially dependent upon a constant height level of the material to be cut. It is therefore intended that, as a result of the spiked cylinder 10, a portion of the tobacco rib flow should always be guided back onto the vibratory conveyor 7 by a drive of the spiked cylinder 10 running counter to the direction of flow. For this purpose, the spikes 19 of the spike cylinder 10 reach between the partitions 18 of the vibratory conveyor 7 and comb back a part of the tobacco rib flow counter to the direction of rib transport.

The inclination of the vibratory conveyor 7 and its transport speed are set such that a pile-up of tobacco ribs generally develops in the outlet area of the vibratory conveyor 7. The ascent of the tobacco rib level runs, in normal operation, approximately parallel to the ascending top edges of the partitions 18.

In order further to stabilize and standardize the height level, the sensors 16 and 17 are provided. The sensors are configured for example as light barriers, and control the supply of tobacco ribs via the conveyor belt 5.

Sensors 16 and 17 are spaced in the direction of transport at an interval of approximately ¼ the length of the vibratory conveyor 7. If the sensors are located above the level of the tobacco rib flow, the belt 5 is switched to a maximum supply speed. If the sensor 17, i.e. the downstream sensor in the direction of transport, is covered, the speed of the supply belt 5 switches to a slow speed. As soon as the sensor 16 is also covered, the further supply of the ribs to the conveyor belt 5 is switched off. Sensor 17 will switch supply belt 5 to a higher speed, increasing the tobacco rib supply to vibratory conveyor 7, if the tobacco rib flow level is below a preset limit at sensor 17.

The effect of this sensor controlled operation is that a pile-up area is formed on the vibratory conveyor 7 and that, by means of the spiked cylinder 10, a portion of the tobacco rib material is always guided back counter to the direction of transport of the vibratory conveyor 7. The result of this operation is a highly uniform material supply flow to the press conveyor chains 11 and 12, while the longitudinal orientation of the tobacco ribs is maintained due to the alignment effected by the partitions 18.

In fall shaft 4, sensors 22, 23, and 24 are provided. As soon as the sensor 24 is covered, the conveyor belt 5 can be switched on. If the sensor 23 too is covered, the drive for the supplying vibrator conveyor 3 is switched to a slow speed. If the material height in the fall shaft reaches sensor 22, the supplying vibrator conveyor 3 is switched off.

Figure 2:
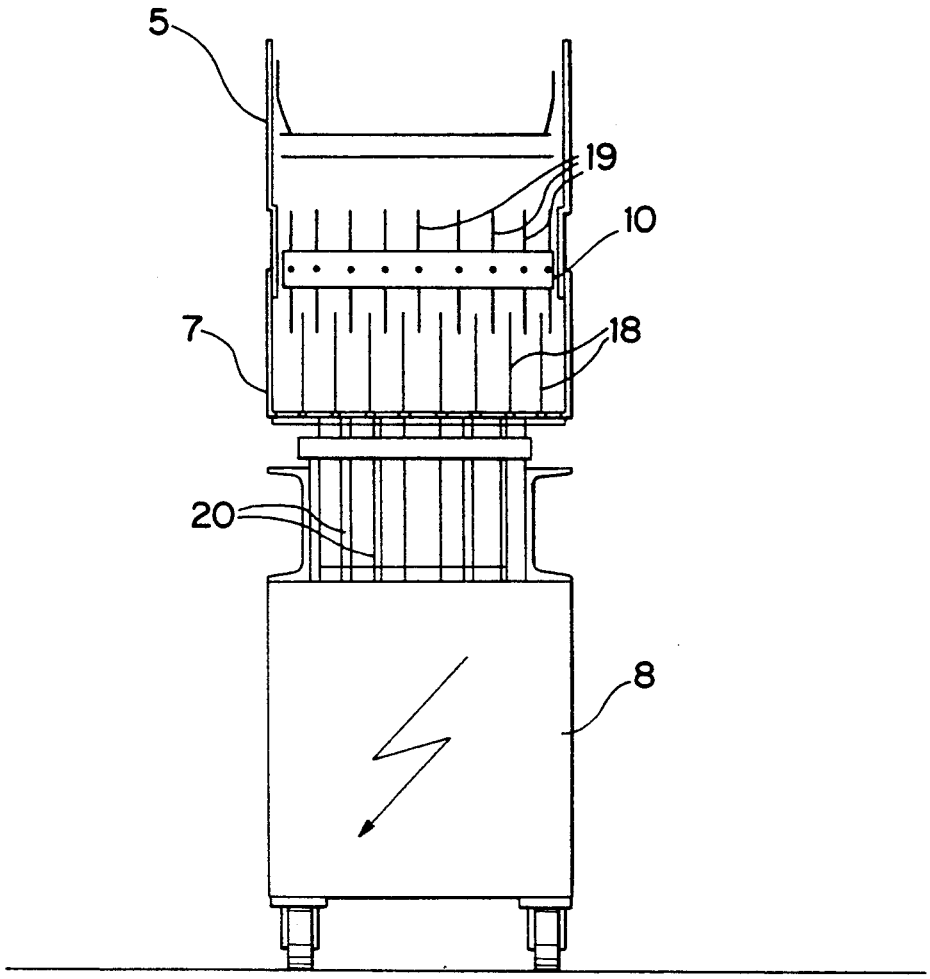
FIG. 2 is a side elevational view in section of the device taken along line 2—2 of FIG. 1.

FIG. 2 shows a sectional view of the device according to FIG. 1 along the line A—A.

On the truck 8, vibratory springs 20 support the trough-shaped vibratory conveyor 7. In the longitudinal direction of the conveyor 7, partitions 18, for example 8 partitions, are firmly connected to the base of the conveyor 7. Above the partitions 18, the spiked cylinder 10 is disposed. The spikes 19 of cylinder 10 are fastened on a belt or on chains and protrude, in part, between the partitions 18.

Above the spiked cylinder 10, the conveyor belt 5 is located. Belt 5, a circulatory belt having a smooth surface.

While a particular embodiment has been chosen to illustrate the invention, it will be understood by those skilled in the art that various changes and modifications can be made therein without departing from the scope of the invention as defined in the appended claims.

What is claimed is:

1. A device for directed supply of tobacco ribs to a cutting tool, comprising:

press conveyor means, disposed upstream of a cutting tool, for conveying tobacco ribs to the cutting tool, said press conveyor means having an inlet area;

vibratory conveyor means, disposed upstream of said press conveyor means, for conveying tobacco ribs into said inlet area, said vibratory conveyor means having vertical partitions extending longitudinally in a tobacco rib transport direction, said partitions being laterally spaced by a distance less than an average tobacco rib length and having ends protruding as far as said press conveyor means; and regulating means for controlling tobacco rib flow level between said partitions by controlling tobacco rib flow volume supplied to said vibratory conveyor means.

2. A device according to claim 1 wherein said vibratory conveyor means is angled downwardly in the tobacco rib transport direction.

3. A device according to claim 2 wherein said partitions comprise top edges ascending in the tobacco rib transport direction.

4. A device according to claim 1 wherein said regulating means sets the tobacco rib flow level between said partitions to ascend in the tobacco rib transport direction.

5. A device according to claim 4 wherein said regulating means comprises a spiked cylinder means for moving tobacco ribs back in a direction counter to the tobacco rib transport direction when the tobacco rib flow level exceeds a predetermined level.

6. A device according to claim 3 wherein said regulating means comprises a spiked cylinder means for moving tobacco ribs back in a direction counter to the tobacco rib transport direction when the tobacco rib flow level exceeds a predetermined level.

7. A device according to claim 2 wherein said regulating means comprises a spiked cylinder means for moving tobacco ribs back in a direction counter to the tobacco rib transport direction when the tobacco rib flow level exceeds a predetermined level.

8. A device according to claim 1 wherein said regulating means comprises a spiked cylinder means for moving tobacco ribs back in a direction counter to the tobacco rib transport direction when the tobacco rib flow level exceeds a predetermined level.

9. A device according to claim 8 wherein said regulating means comprises first and second sensor means, spaced in the tobacco rib transport direction on said vibratory conveyor means, for detecting the tobacco rib flow level, said first sensor means being upstream of said second sensor means, first sensor means halting tobacco rib supply to said vibratory conveyor means if the tobacco rib flow level exceeds a preset limit at said first sensor means, said second sensor means increasing the tobacco rib supply to the said vibratory conveyor means if the tobacco rib flow level is below a preset limit at said second sensor means.

10. A device according to claim 7 wherein said regulating means comprises first and second sensor means, spaced in the tobacco rib transport direction on said vibratory conveyor means, for detecting the tobacco rib flow level, said first sensor means being upstream of said second sensor means, first sensor means halting tobacco rib supply to said vibratory conveyor means if the tobacco rib flow level exceeds a preset limit at said first sensor means, said second sensor means increasing the tobacco rib supply to the said vibratory conveyor means if the tobacco rib flow level is below a preset limit at said second sensor means.

11. A device according to claim 6 wherein said regulating means comprises first and second sensor means, spaced in the tobacco rib transport direction on said vibratory conveyor means, for detecting the tobacco rib flow level, said first sensor means being upstream of said second sensor means, first sensor means halting tobacco rib supply to said vibratory conveyor means if the tobacco rib flow level exceeds a preset limit at said first sensor means, said second sensor means increasing the tobacco rib supply to the said vibratory conveyor means if the tobacco rib flow level is below a preset limit at said second sensor means.

12. A device according to claim 5 wherein said regulating means comprises first and second sensor means, spaced in the tobacco rib transport direction on said vibratory conveyor means, for detecting the tobacco rib flow level, said first sensor means being upstream of said second sensor means, first sensor means halting tobacco rib supply to said vibratory conveyor means if the tobacco rib flow level exceeds a preset limit at said first sensor means, said second sensor means increasing the tobacco rib supply to the said vibratory conveyor means if the tobacco rib flow level is below a preset limit at said second sensor means.

* * * * *